United States Patent [19]

Takahashi et al.

[11] 4,085,351

[45] Apr. 18, 1978

[54] GASEOUS DISCHARGE LIGHT EMITTING ELEMENT

[75] Inventors: Kōichi Takahashi, Odawara; Kinichiro Narita, Chigasaki; Akiyasu Kagami, Ninomiya; Takashi Hase, Fujisawa; Yoshiyuki Mimura, Chigasaki; Yoshinori Tanigami, Odawara; Junro Koike, Machida; Ryuya Toyonaga, Ebina; Takehiro Kojima, Kawasaki, all of Japan

[73] Assignees: Dai Nippon Toryo Co., Ltd., Osaka; Nippon Hoso Kyokai, Tokyo, both of Japan

[21] Appl. No.: 761,988

[22] Filed: Jan. 24, 1977

[30] Foreign Application Priority Data

May 26, 1976 Japan ..... 51-60808

[51] Int. Cl.[2] ..... H01J 61/18; H01J 61/44

[52] U.S. Cl. ..... 313/486; 252/301.4 R; 313/226

[58] Field of Search ..... 313/486, 226; 252/301.4 R, 301.6 R

[56] References Cited

U.S. PATENT DOCUMENTS

| | | | |
|---|---|---|---|
| 3,396,119 | 8/1968 | Maiman et al. | 252/301.4 R |
| 3,635,833 | 1/1972 | Datta | 252/301.4 R |
| 3,916,245 | 10/1975 | Dorf et al. | 313/486 |
| 4,000,436 | 12/1976 | Toryu et al. | 313/226 X |

OTHER PUBLICATIONS

"Some Aspects of the Luminescence of Solids", by F. A. Kroger, Table III, pp. 270–273, 1948.

*Primary Examiner*—Palmer C. Demeo
*Attorney, Agent, or Firm*—Fleit & Jacobson

[57] ABSTRACT

In an air-tight at least partially transparent container, a phosphor, a gas or gas mixture and a pair of discharging electrodes are contained. The discharge gap is in the range of 0.1 to 3.0mm, and the pressure of the gas or gas mixture sealed in the container is such that the product of the pressure and the discharge gap is in the range of 30 to 300 Torr.mm. The gas or gas mixture has discharge radiation spectra within the region of wavelength shorter than 200nm. The phosphor is a manganese activated aluminate phosphor represented by the formula $$(M^{II}_{1-x}, Mn_x)\ O{\cdot}zAl_2O_3$$

where $M^{II}$ is selected from a group consisting of calcium, strontium, barium, magnesium and zinc, and $x$ and $z$ are numbers within the ranges of $10^{-3} \leqq x \leqq 7 \times 10^{-1}$ and $1 \leqq z \leqq 20$, respectively.

9 Claims, 10 Drawing Figures

GASEOUS DISCHARGE LIGHT EMITTING ELEMENT

BACKGROUND OF THE INVENTION

1. Field of the Invention

This invention relates to a gaseous discharge light emitting element, and more particularly to a light emitting element which, being of the type employing a green emission phosphor excited by ultraviolet rays irradiated by gaseous discharge, comprises an air-tight container, a gas, a phosphor and a pair of discharge electrodes sealed therein and is appropriate for use as a small lamp or use in an image display panel.

This invention is particularly concerned with a novel combination of a gas and a phosphor sealed in the air-tight container of the light emitting element which combination effects a high radiation efficiency. In the light emitting element, the discharge gap is in the range of 0.1 to 3.0mm and the pressure of the gas sealed in the container is such that the product of the pressure and the discharge gap (hereinafter referred to as "pd product") is in the range of 30 to 300 Torr·mm.

2. Description of the Prior Art

It has been known in the art to excite a phosphor with ultraviolet rays emitted by gaseous discharge to cause the phosphor to emit light. For instance, fluorescent lamps employ a phosphor which is excited by ultraviolet rays having a wavelength of 253.7nm emitted by a gaseous discharge in a mercury vapor. When the gap between a pair of discharge electrodes within a small lamp is smaller than 3mm, the pressure of the gas sealed in the lamp is required to be as high as several ten to several hundred Torr in accordance with Paschen's law. In small lamps or image display panels in which the gap between the electrodes is smaller than 3mm, therefore, the radiation of ultraviolet rays cannot be obtained effectively since the vapor pressure of mercury sealed within the lamp together with other gases such as argon is very low. In order to effectively produce ultraviolet rays by a gaseous discharge, it is necessary to heat the discharge lamp or the image display panel with a heater or the like so as to increase the vapor pressure of mercury therein. However, this requires consumption of electric power for heating and necessitates use of a large sized heating panel when the image display panel has a large size, and accordingly it is impractical to heat the discharge lamp or the like. Further, from the point of environmental pollution it is undesirable to use a large amount of mercury. Therefore, in general, this kind of discharge lamp and other similar devices usually employ a rare gas, a hydrogen gas or a nitrogen gas or an appropriate mixture of these gases because with such gases a pressure of several ten to several hundred Torr can easily be obtained at room temperatures. The ultraviolet rays emitted by the gaseous discharge in the above mentioned gas or gas mixture have radiation spectra of high intensity mostly within the so-called vacuum ultraviolet region corresponding to the wavelength of shorter than 200nm.

As a conventional phosphor which is used in image display panels employing gaseous discharge with a discharge gap of 0.1 to 3.0mm and pd product of 30 to 300 Torr·mm and emitting green light under excitation by ultraviolet rays having a wavelength of shorter than 200nm, there has been known a manganese activated zinc silicate ($Zn_2SiO_4$:Mn). In this phosphor, however, an improvement is desired in its color purity and life.

SUMMARY OF THE INVENTION

In view of the above described defects inherent in the conventional light emitting elements, the primary object of the present invention is to provide a gaseous discharge light emitting element which has a high radiation efficiency under excitation in the vacuum ultraviolet region. The radiation efficiency is defined as the ratio of the emission intensity (watt) to the excitation intensity (watt).

Another object of the present invention is to provide a gaseous discharge light emitting element which provides green light emission of high brightness.

Still another object of the present invention is to provide a gaseous discharge light emitting element which provides green light emission of high color purity.

A further object of the present invention is to provide a gaseous discharge light emitting element which has a long life.

The above objects are accomplished by employing as the phosphor a manganese activated aluminate phosphor represented by the formula, $$(M_{1-x}^{II}, Mn_x)\ O{\cdot}zAl_2O_3$$

where $M^{II}$ is selected from a group consisting of calcium, strontium, barium, magnesium, and zinc, and $x$ and $z$ are numbers within the ranges of $10^{-3} \leqq x \leqq 7 \times 10^{-1}$ and $1 \leqq z \leqq 20$, respectively, and as the gas a gas which has its discharge radiation spectrum in the region of the wavelength shorter than 200nm. The gaseous discharge light emitting element of this invention employing the combination of the above phosphor and the gas has a discharge gap of 0.1 to 3.0mm and a pd product of 30 to 300 Torr·mm. The above defined phosphor has high radiation efficiency within the wavelength region of from 120 to 120nm in comparison with the conventional phosphors. Therefore, the gaseous discharge light emitting element employing the above defined phosphor has high radiation efficiency. Further, the radiation efficiency of the manganese activated aluminate phosphor is not lowered through a process of applying the same to a wall of a gaseous discharge light emitting element. Thus, the brightness and the radiation efficiency of an image display panel employing the light emitting element in accordance with the present invention are markedly enhanced in comparison with the conventional image display panels.

It should be noted that it has not been known in the art that the manganese activated aluminate phosphor could emit light with high efficiency under excitation by short wavelength ultraviolet ray (253.7nm) and long wavelength ultraviolet ray (365.0nm). However, it has now been discovered by the present inventors that the radiation efficiency of this phosphor under vacuum ultraviolet ray excitation when the phosphor has the above defined composition.

DESCRIPTION OF THE PREFERRED EMBODMENTS

Now the present invention will be described in detail with reference to preferred embodiments thereof. Prior to a detailed description of the preferred embodiments, there will be given as background a general explanation of the phenomenon of gaseous discharge.

As is well known in the art, vacuum ultraviolet rays are emitted by glow discharge in various kinds of gases. Among the wavelengths of the vacuum ultraviolet rays obtained by glow discharge, those which have particularly high radiation intensity are shown in Table I below, together with the kind of gases in which the radiations are obtained.

TABLE I

| Gas | Wavelength of high intensity radiation (nm) | | |
|---|---|---|---|
| Hydrogen | 121.6 | 161.6 | many line spectra around 160 |
| Helium | 58.4 | 59.2 | continuous spectra 58–110 |
| Nitrogen | | many line spectra 100–150 | |
| Neon | 73.6 | 74.3 | continuous spectra 74–100 |
| Argon | 104.8 | 106.7 | continuous spectra 105–155 |
| Krypton | 116.5 | 123.6 | continuous spectra 125–180 |
| Xenon | 129.6 | 147.0 | continuous spectra 148–200 |

Figure 1:
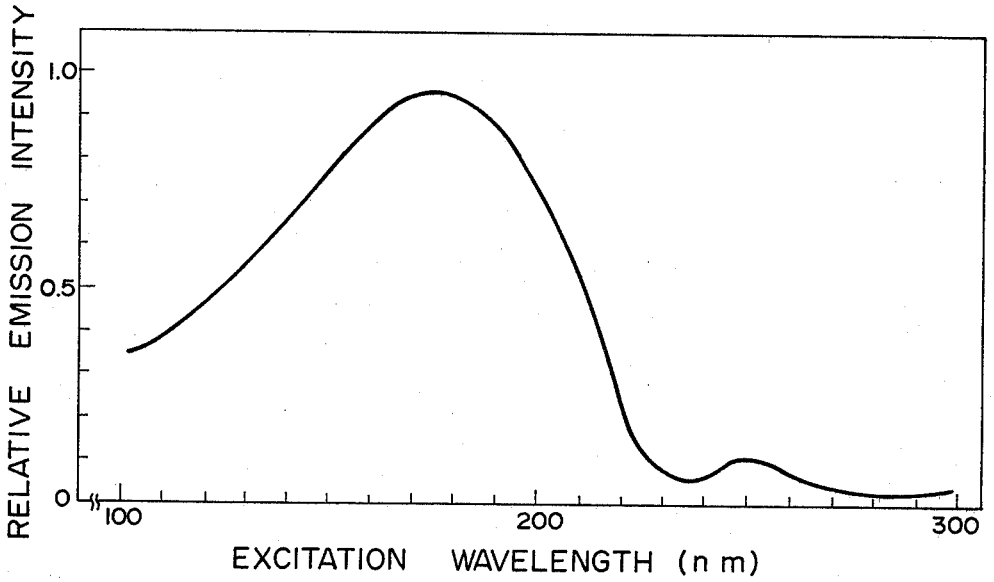
FIG. 1 shows the excitation spectrum of a manganese activated aluminate phosphor employed in the gaseous present invention.

The excitation spectrum of the phosphor, i.e., manganese activated aluminate phosphor, employed in the present invention is shown in FIG. 1. The curve shown in FIG. 1 represents the excitation spectra of a manganese activated aluminate represented by the formula, $(Ba_{0.9}, Mn_{0.1})0.6Al_2O_3$. Even if $Mn^{II}$ and *x* and *z* in the foregoing formula change, the excitation spectra is substantially the same as that shown in FIG. 1. The excitation spectra was obtained by use of a vacuum spectroscope. The relative emission intensity represented along the ordinate of the graph shown in FIG. 1 indicates the ratio of the emission intensity of the aforesaid phosphors to that of sodium salicylate powder.

As shown in FIG. 1, the emission intensity of the manganese activated aluminate phosphor employed in the present invention is high in the vacuum ultraviolet region of wavelengths below 200nm, particularly in the region of about 120 to 200nm.

In view of the spectra of vacuum ultraviolet rays shown in Table I and the emission intensity of the phosphor shown in FIG. 1, the combination of the manganese activated aluminate phosphor and the radiation obtained by glow discharge in a single gas such as hydrogen, nitrogen, argon, krypton or xenon is preferred to effect an emission of high intensity. Further, although a single gas may be used for obtaining light emission in a gaseous discharge light emitting element, a mixture of gases is more desirable in practical use in order to improve the discharge firing potential, maintaining potential, stability of the discharge and efficiency of radiation of ultraviolet rays. Therefore, in the practical gaseous discharge element, a mixture of gases is sealed in an air-tight at least partially transparent container. Several examples of mixtures of gases which are suitable for the aforesaid phosphor employed in this invention are shown in Table II. Most of the examples shown in Table II are of mixtures consisting of two gases. It will be readily understood that mixtures of more than two gases can be used for causing a gaseous discharge which emits ultraviolet rays having a wavelength of shorter than 200nm.

TABLE II

| Basic gas | Mixture of gas |
|---|---|
| Argon | Helium + Argon |
| Krypton | Helium + Krypton, Neon + Krypton |
| | Argon + Krypton, Helium + Argon + Krypton |
| Xenon | Helium + Xenon, Neon + Xenon |
| | Argon + Xenon, Helium + Argon + Xenon |
| Hydrogen | Argon + Hydrogen, Helium + Hydrogen |
| | Neon + Hydrogen |
| Nitrogen | Helium + Nitrogen, Argon + Nitrogen |

The radiation efficiency effected when a mixture of helium and xenon (2%) sealed under a total pressure of 150 Torr is used together with each of several phosphors including the phosphor employed in the present invention and the conventional phosphor is shown in Table III below. In Table III, Phosphor (1) is a conventionally known phosphor, i.e., manganese activated zinc silicate represented by the formula $Zn_2SiO_4$:Mn, and Phosphors (2) to (7) are the phosphors employed in the present invention, i.e., manganese activated aluminate phosphor represented by the formulae (2): $(Ca_{0.9}, Mn_{0.1})0.6Al_2O_3$, (3): $(Sr_{0.9}, Mn_{0.1})O.\ 6Al_2O_3$, (4): $(Ba_{0.9}, Mn_{0.1})\ 0.6Al_2O_3$, (5): $(Ba_{0.3}, Mg_{0.6}, Mn_{0.1})\ O.\ 8Al_2O_3$, (6): $(Mg_{0.9}, Mn_{0.1})\ 0.6Al_2O_3$ and (7): $(Zn_{0.9}, Mn_{0.1})\ 0.6Al_2O_3$.

TABLE III

| Phosphor | Luminance (ft-L) | Relative Radiation Efficiency |
|---|---|---|
| (1) | 35 | 1.00 |
| (2) | 11 | 0.34 |
| (3) | 20 | 0.62 |
| (4) | 35 | 1.08 |
| (5) | 30 | 0.92 |
| (6) | 10 | 0.31 |
| (7) | 18 | 0.54 |

Figure 2:
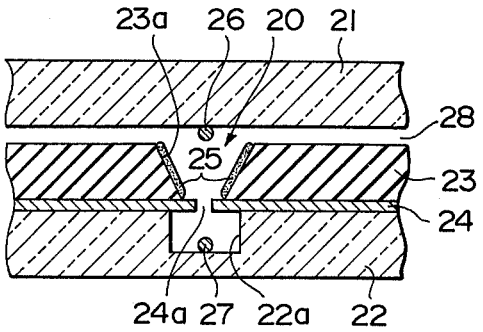
FIG. 2 is a fragmentary sectional view showing a gaseous discharge cell employed in an embodiment of the gaseous discharge light emitting element in accordance with the present invention.

The results shown in Table III were obtained by use of an embodiment of the gaseous discharge light emitting element in accordance with the present invention partly shown in FIG. 2. The light emitting element as shown in FIG. 2 is an image display panel comprising a number of (more than nine) cells 20. The image display panel including the cells 20 is composed of a front glass plate 21, a rear glass plate 22 arranged in parallel to said front glass plate 21 with a space formed therebetween, and an intermediate layer 23 disposed on the rear glass plate 22 with a number of parallel strip-like cathodes 24 interposed between the intermediate layer 23 and the rear glass plate 22. The cathode 24 has a through-hole 24*a* and the rear glass plate 22 has a number of parallel grooves 22*a* behind the through-hole 24*a* of the cathodes 24. The intermediate layer 23 is provided with a number of tapered holes 23*a* above said through-holes 24*a* of the cathodes 24. On the wall of the tapered holes 23*a* are applied coating layers 25 of a green emitting phosphor as said phosphors (1)–(7). A number of parallel anodes 26 made of wires are provided on the inner surface of the front glass plate 21 at the positions above said tapered hole 23*a* of the intermediate layer 23. A number of auxiliary anodes 27 are provided on the bottom of said grooves 22*a* of the rear glass plate 22 at the positions below said anodes 26 on the front glass plate 21. An air gap 28 is formed between the inner surface of the front glass plate 21 and the surface of the intermediate layer 23. The discharge gap between the cathodes 24 and the anodes 26 is selected to be in the range of 0.1 to 3.0mm. A gas mixture of helium and xenon (2%) is sealed under a total pressure of 150 Torr in the space in the grooves 22*a*, the tapered holes 23*a* and the air gap 28. The pressure within the space is selected to be such that the pd product is in the range of 30 to 300 Torr·mm and a DC potential is applied across the cathode 24 and the anode 26 to create a glow discharge therebetween. Ultraviolet rays are generated by glow discharge and the phosphor applied to the tapered hole 23*a* as the coating layer 25 is excited to emit green light. The radiation efficiency was measured by first measuring the radiation intensity of the light emitted from the phosphor coating layer 25 by use of a photomultiplier located close to the front glass plate 21 and then dividing the power of radiation calculated in accordance with spectral response characteristics by the input electric power.

The luminance shown in Table III is absolute luminance (ft-L) and the radiation efficiency is of relative normalized value with respect to that of $Zn_2SiO_4$:Mn phosphor. The results shown in Table III make it clear that the gaseous discharge light emitting element which employs a manganese activated aluminate phosphor containing barium has a particularly high value in the luminance and radiation efficiency which is as high as that obtained by the conventional light emitting element of this kind employing $Zn_2SiO_4$:Mn phosphor. Although Table III shows the results obtained when a mixture of helium and xenon is sealed, almost the same results can be obtained even when mixtures of gases such as Ne-Xe, Ar-Xe and He-Kr which effectively emit ultraviolet rays having a wavelength in the region of 120 to 200nm. Further, it has also been proved that the gaseous discharge light emitting element in accordance with the present invention is capable of efficiently emitting light under vacuum ultraviolet ray excitation in various other kinds of single gas or mixture of gases.

It has been known in the art to further activate the manganese activated aluminate phosphor with europium in order to enhance the emission efficiency when the manganese activated aluminate is excited with ultraviolet rays having the wavelength of 253.7 or 365.0nm. The gaseous discharge light emitting element in accordance with the present invention is also able to be activated with the europium if the amount of the europium is within the range where the europium will not cause blue light to emit from the phosphor (e.g. $5\times10^{-3}$ gram·atom/mol).

Figure 3:
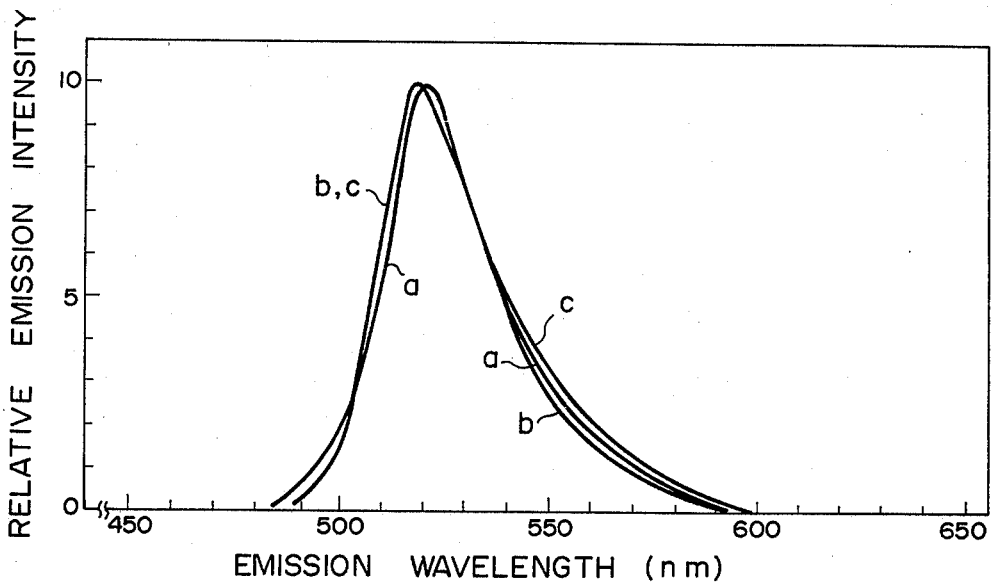
FIG. 3 shows the emission spectra of a gaseous discharge light emitting element in accordance with the present invention.

Fig. 3 shows the emission spectra of the gaseous discharge light emitting element employing a manganese activated aluminate in accordance with the present invention, wherein curves-*a*, *b* and *c* are spectra of the phosphors (2), (3) and (4), respectively.

Table IV below shows the relative radiation efficiency of various gas mixtures in the gaseous discharge light emitting elements in accordance with the present invention as shown in FIGS. 2 and 8 to 10.

TABLE IV

| Mixture of gases | He-Xe (Xe:2%) | He-Xe (Xe:2%) | Ar-Xe (Xe:10%) | He-Kr (Kr:6%) | Ne-Xe Xe:10%) |
|---|---|---|---|---|---|
| Discharge gap d(mm) | 1.5 | 0.25 | 1.5 | 2.0 | 1.5 |
| Pd product (Torr.mm) | 225 | 50 | 30 | 200 | 120 |
| Phosphor (1) | 1.0 | 1.0 | 1.0 | 1.0 | 1.0 |
| Phosphor (4) | 1.1 | 1.2 | 1.2 | 1.0 | 1.0 |

The results shown in Table IV were obtained in the same manner as that employed to obtain the results shown in Table III. The composition of the gas mixture, the discharge gap and the pd product were changed in the measurements. Table IV indicates that the relative radiation efficiency of the gaseous discharge light emitting element in accordance with the present invention having the discharge gap of 0.25 to 2.0mm and the pd product of 30 to 225 Torr·mm wherein the phosphor (4) is employed is high. The relative radiation efficiency with the other phosphor (2), (5), (6) or (7) is also as high as that with the phosphor (4).

Although Table IV shows only five different compositions of mixtures of gases as indicated, single gases or mixtures of gases as shown in Tables I and II are also useful for the considerable enhancement of the radiation efficiency. Further, it should be noted that the gaseous discharge light emitting elements which have the discharge gap of 0.1 to 3.0mm and the pd product of 30 to 300 Torr·mm can be used as the light emitting elements in accordance with the present invention to enhance the radiation efficiency and should be regarded as variations or embodiments of the present invention included within the scope of the spirit of the present invention.

Figure 4:
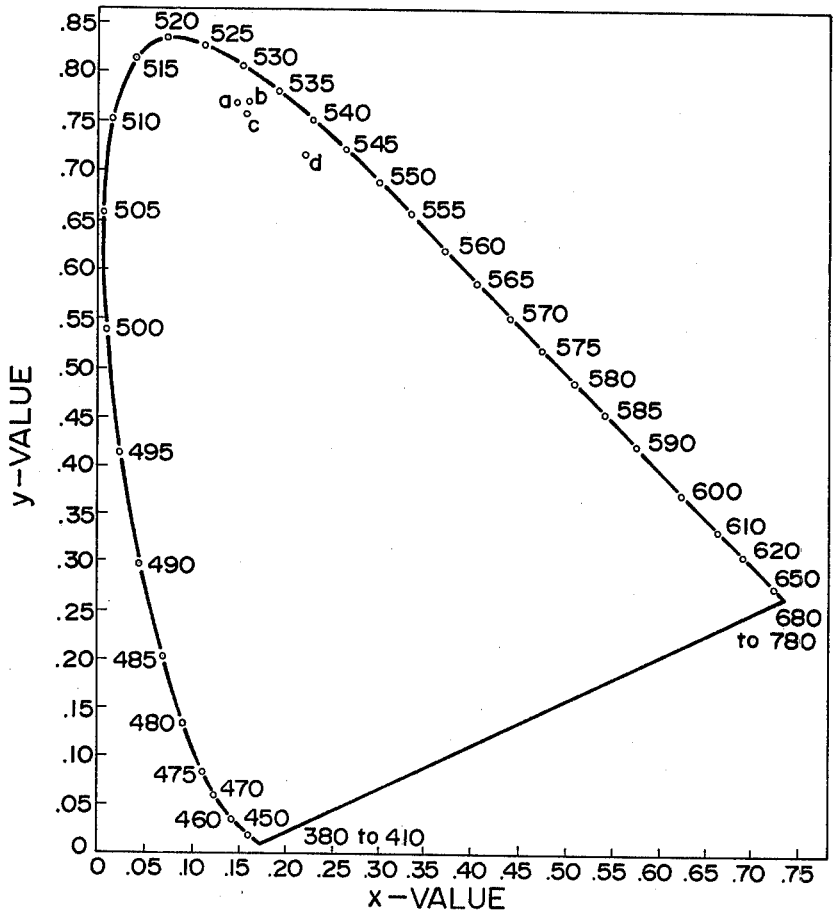
FIG. 4 is a chromaticity diagram showing the chromaticity of the emissions obtained by a conventional gaseous discharge light emitting element employing $Zn_2SiO_4$:Mn and by the present invention, wherein chromaticity points *a, b* and *c* are of the present invention and *d* is of the conventional one.

The color of the light emitted from the phosphor coating layer 25 of the cell 20 using the phosphor (2), (3) or (4) is the same and purer than that of the light emitted from the conventional phosphor such as said phosphor (1). The chromaticity of the color of light emitted by various phosphors including both the conventional phosphor and the phosphor of the present invention are indicated in the chromaticity diagram shown in FIG. 4. The diagram shown in FIG. 4 is the CIE chromaticity diagram in which chromaticity *a*, *b* and *c* are indicative of the color of light emitted from said phosphors (2), (3) and (4) of the present invention and *d* is indicative of the color of light emitted from a conventionally known manganese activated zinc silicate phosphor, i.e., phosphor (1). As shown in FIG. 4, the color of the light emitted from the phosphors (2), (3) and (4) of the present invention is superior to that of the light emitted from the conventionally known phosphor as mentioned hereinabove. Therefore, these phosphors are capable of providing superior color reproduction over a wide range of color when combined with blue and red emitting phosphors to perform a multi-color display.

Figure 5:
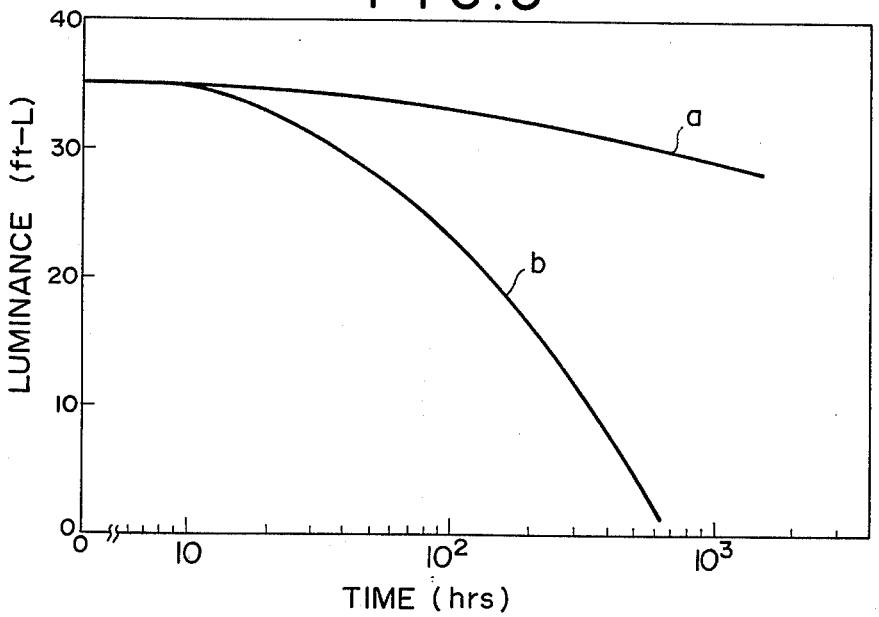
FIG. 5 is a graph showing the life of the emission obtained by a conventional gaseous discharge light emitting element and by the present invention.

FIG. 5 shows the life of the luminance of the gaseous discharge light emitting element in accordance with the present invention employing the phosphor (4) (curve-a) and that of the conventional gaseous discharge light emitting element employing $Zn_2SiO_4$:Mn (curve-*b*), wherein the abscissa represents the working time and the ordinate represents the luminance. The light emitting element used in the experiment was of the type as shown in FIG. 2. As shown in FIG. 5, the life of the light emitting element in accordance with the present invention represented by curve-*a* is much longer than that of the conventional one represented by curve-*b*. Similar results were obtained for the light emitting element in accordance with the present invention employing other phosphors as listed hereinbefore.

Now the desirable ratio of incorporation of the phosphor components employed in the present invention will be described in detail hereinbelow. The phosphor to be employed in the present invention is represented by the formula $$(M_{1-x}^{II}, Mn_x)\,O{\cdot}zAl_2O_3$$

The value $z$ will be described with reference to FIG. 6, and the value $x$ will be described with reference to FIG. 7.

Figure 6:
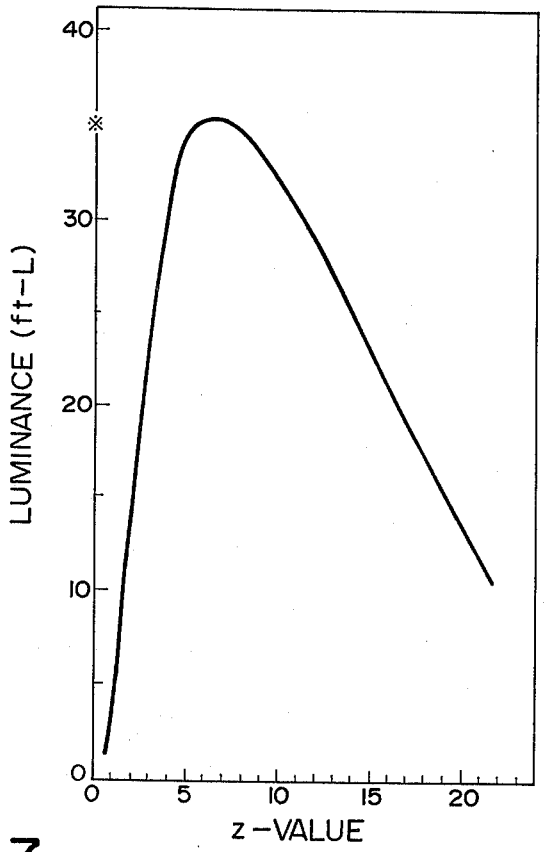
FIG. 6 is a graph showing the relationship between the luminance of the light emitting element of this invention and the amount of aluminum oxide (value-*z*) in the phosphor employed therein.

FIG. 6 is a graphical representation showing the relation between the luminance and the value $z$ of the phosphor represented by the formula $(Ba_{0.9}, Mn_{0.1})O{\cdot}zAl_2O_3$. In the graph, the abscissa indicates the value $z$ and the ordinate indicates the absolute luminance (*ft*-L) of the phosphor. A mark * shown on the ordinate indicates the luminance of the conventional gaseous discharge light emitting element employing $Zn_2SiO_4$:Mn phosphor. As shown in FIG. 6, the luminance is high where $1 \leqq z \leqq 20$ and is particularly high in the region of $3 \leqq z \leqq 15$. Further, it has also been proved that similar results are obtained with other phosphors within the scope of this invention.

Figure 7:
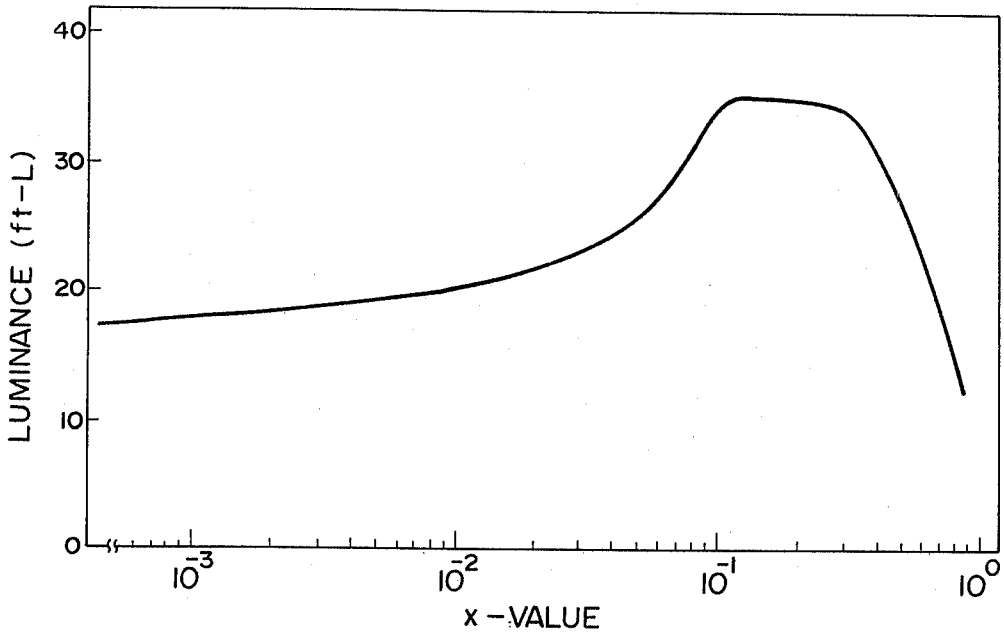
FIG. 7 is a graph showing the relationship between the luminance of the light emitting element of this invention and the amount of manganese (value-*x*) in the phosphor employed therein.

FIG. 7 is a graphical representation showing the relation between the luminance and the value $x$ *l of the phosphor represented by the formula* $(Ba_{1-x}, Mn_x)O{\cdot}6Al_2O_3$. In the graph, the abscissa indicates the value $x$ and the ordinate indicates the absolute luminance (*ft*-L) of the phosphor. As shown in FIG. 7, the luminance is high where $10^{-3} \leqq x \leqq 7 \times 10^{-1}$ and is particularly high in the region of $5 \times 10^{-2} \leqq x \leqq 5 \times 10^{-1}$. Further, it has also been proved that similar results are obtained with other phosphors within the scope of this invention.

Summarizing the above described results, the preferable ranges of the values $x$ and $z$ are $10^{-3} \leqq x \leqq 7 \times 10^{-1}$ and $1 \leqq z \leqq 20$, and the particularly desirable ranges thereof are $5 \times 10^{-2} \leqq x \leqq 5 \times 10^{-1}$ and $3 \leqq z \leqq 15$.

Figure 8:
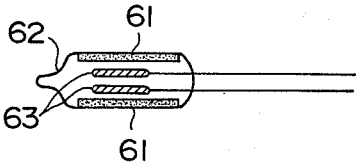
FIG. 8 is a longitudinal sectional view of a small lamp of diode type which can be used as a light emitting element in the present invention.

The combination of the phosphor represented by said formula wherein the values $x$ and $z$ are defined as mentioned above and the gas or gas mixture which has discharge radiation spectra in the vacuum ultraviolet region of wavelength of below 200nm may be used in various conventionally known structures of light emitting elements. Several examples of the light emitting elements in which said combination of the phosphor and gas or gas mixture will be described hereinbelow with reference to FIGS. 8 to 10. FIG. 8 shows a small lamp of diode type, and FIGS. 9 and 10 show image display panels composed of a number of gaseous discharge cells arranged in a matrix.

Referring to FIG. 8, a phosphor layer 61 is applied to the internal surface of a tube 62 and a pair of electrodes 63 are provided in the tube 62 to make a gaseous discharge therebetween and cause the phosphor layer 61 to be excited by radiations emitted by the discharge. Thus, by applying a potential across the pair of electrodes 63, the phosphor layer 61 is excited to emit light.

Figure 9:
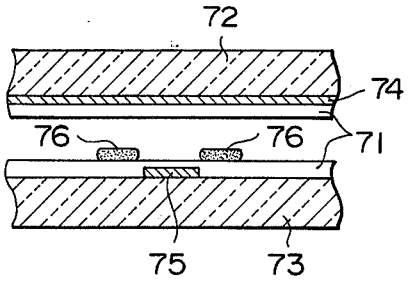
FIGS. 9 and 10 are fragmentary sectional views each showing an example of a gaseous discharge image display panel which can be used as a light emitting element in the present invention.

FIG. 9 shows the structure of an image display panel developed by Owens Illinois Corporation. Dielectric layers 71 are applied on a pair of oppositely disposed glass plates 72 and 73 on the inner surfaces thereof. Between the dielectric layers 71 and the glass plates 72 and 73, electrode strips 74 and 75 extending in directions perpendicular to each other are provided. On one dielectric layer 71, phosphor layers 76 are disposed so as to be excited by ultraviolet rays produced by a gaseous discharge created between the electrode strips 74 and 75 through the dielectric layers 71. The phosphor layers 76 are disposed around the positions where the upper electrode strips 74 and the lower electrode strips 75 cross with each other.

Figure 10:
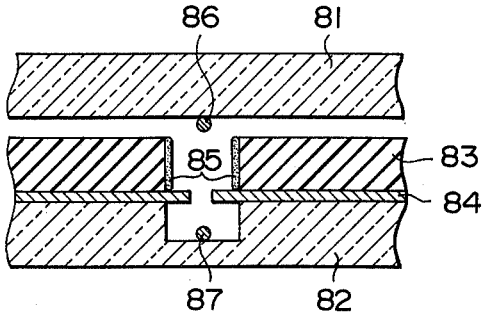

FIG. 10 shows the structure of an image display panel developed by Burroughs Corporation, which is very similar to the embodiment shown in FIG. 2. The elements designated by reference numerals 81 to 87 are all equivalent to those shown in FIG. 2 designated by 21 to 27, respectively, and accordingly the detailed description thereof is omitted here since the function thereof will be obvious to those skilled in the art.

In the light emitting elements as shown in FIGS. 8 to 10, gases or gas mixtures as given in Table II or III can be employed to improve the radiation efficiency insofar as the discharge gap is in the range of 0.1 to 3.0mm and the pd product is in the range of 30 to 300 Torr·mm.

We claim:

1. A gaseous discharge light emitting element comprising an air-tight at least partially transparent container, a pair of discharge electrodes provided in said container, the discharge gap between said electrodes being in the range of 0.1 to 3.0 mm, a gas or gas mixture having discharge radiation spectra within the region of wavelength shorter than 200nm sealed in said container, the pressure of said gas or gas mixture being such that the product of the pressure and said discharge gap is in the range of 30 to 300 Torr·mm, and a phosphor disposed in said container, said phosphor having a high radiation efficiency under vacuum ultraviolet ray excitation and comprising a manganese activated aluminate phosphor represented by the formula:

$$(M^{II}_{1-x}, Mn_x)\,O{\cdot}zAl_2O_3$$

wherein $M^{II}$ is selected from a group consisting of calcium, strontium, barium, magnesium and zinc, and $x$ and $z$ are numbers within the ranges of $10^{-3} \leqq x \leqq 7 \times 10^{-1}$ and $1 \leqq z \leqq 20$, respectively.

2. A gaseous discharge light emitting element as defined in claim 1 wherein said $x$ is within the range of $5 \times 10^{-2} \leqq x \leqq 5 \times 10^{-1}$.

3. A gaseous discharge light emitting element as defined in claim 1 wherein said $z$ is within the range of $3 \leqq z \leqq 15$.

4. A gaseous discharge light emitting element as defined in claim 1 wherein said gas or gas mixture contains at least one gas selected from the group consisting of helium, neon, argon, krypton and xenon or mixture thereof.

5. A gaseous discharge light emitting element as defined in claim 4 wherein said gas mixture is composed of xenon and at least one gas selected from the group consisting of helium, neon and argon.

6. A gaseous discharge light emitting element as defined in claim 4 wherein said gas mixture is composed of helium and krypton.

7. A gaseous discharge light emitting element as defined in claim 1 wherein said container is a tube and said phosphor is applied to the inner surface of the tube.

8. A gaseous discharge light emitting element as defined in claim 1 wherein said container is provided therein with a plurality of pairs of electrodes arranged in a matrix, whereby an image is displayed by the combination of the electrode pairs excited.

9. A gaseous discharge light emitting element as defined in claim 8 wherein a cell defined by a wall coated with said phosphor is disposed between each pair of electrodes.

* * * * *